US006401839B1

(12) United States Patent
Chen

(10) Patent No.: US 6,401,839 B1
(45) Date of Patent: Jun. 11, 2002

(54) ROLLER CONE BITS, METHODS, AND SYSTEMS WITH ANTI-TRACKING VARIATION IN TOOTH ORIENTATION

(75) Inventor: Shilin Chen, Plano, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/523,474

(22) Filed: Mar. 10, 2000

Related U.S. Application Data

(63) Continuation-in-part of application No. 09/387,304, filed on Aug. 31, 1999, now Pat. No. 6,095,262.
(60) Provisional application No. 60/098,442, filed on Aug. 31, 1998.

(51) Int. Cl.[7] ..... E21B 10/16
(52) U.S. Cl. ..... 175/57; 175/374; 175/376; 175/378; 76/108.2

(58) Field of Search ..... 175/374, 376, 175/377, 378, 426, 57; 76/108.2

(56) References Cited

U.S. PATENT DOCUMENTS

| | | | | | |
|---|---|---|---|---|---|
| 4,334,586 | A | * | 6/1982 | Schumacher | 175/374 |
| 4,343,371 | A | * | 8/1982 | Baker, III et al. | 175/336 |
| 4,393,948 | A | * | 7/1983 | Fernandez | 175/373 |
| 5,197,555 | A | * | 3/1993 | Estes | 175/431 |
| 5,224,560 | A | * | 7/1993 | Fernandez | 175/374 |
| 6,095,262 | A | * | 8/2000 | Chen | 175/57 |
| 6,241,034 | B1 | * | 6/2001 | Teinke et al. | 175/331 |

* cited by examiner

*Primary Examiner*—Hoang Dang
(74) *Attorney, Agent, or Firm*—Groover & Associates; Robert Groover

(57) ABSTRACT

A roller cone drill bit in which the orientations of the teeth are varied within a single row, and/or between the heel row of one cone and the heel row of another cone, to prevent tracking.

11 Claims, 5 Drawing Sheets

Cone: 1; Bit: era22d; Bit RPM=60; ROP=10ft/h; Cone RPM=86.7591; Cut area=11.047%

Cone: 1; Bit: era22d; Bit RPM=60; ROP=10ft/h; Cone RPM=86.7591; Cut area=16.0792%

Cone: 1; Bit: era22d; Bit RPM=60; ROP=10ft/h; Cone RPM=86.7591; Cut area=11.047%

ROLLER CONE BITS, METHODS, AND SYSTEMS WITH ANTI-TRACKING VARIATION IN TOOTH ORIENTATION

CROSS-REFERENCE TO OTHER APPLICATION

This application is a continuation-in-part of U.S. application Ser. No. 09/387,304 filed Aug. 31, 1999 (now issued as U.S. Pat. No. 6,095,262), and therethrough claims priority from U.S. provisional application 60/098,442 filed Aug. 31, 1998, which is hereby incorporated by reference.

BACKGROUND AND SUMMARY OF THE INVENTION

The present invention relates generally to the drilling of oil and gas wells, or similar drilling operations, and in particular to orientation of tooth angles on a roller cone drill bit.

Background: Rotary Drilling

Oil wells and gas wells are drilled by a process of rotary drilling, using a drill rig such as is shown in FIG. 5. In conventional vertical drilling, a drill bit 50 is mounted on the end of a drill string 52 (drill pipe plus drill collars), which may be miles long, while at the surface a rotary drive (not shown) turns the drill string, including the bit at the bottom of the hole.

Two main types of drill bits are in use, the fixed or drag bit, seen in FIG. 4, and the roller cone bit, seen in FIG. 3. In the roller cone bit a set of cones 36 (two are visible in this drawing) having teeth or cutting inserts 38 are arranged on rugged bearings on the arms 37 of the bit. As the drill string is rotated, the cones will roll on the bottom of the hole, and the teeth or cutting inserts will crush the formation beneath them. Drilling fluid, which is pumped down the drill string under pressure, is directed out nozzles 34, to provide cleaning of the bit and to sweep broken fragments of rock uphole.

Background: Roller Cone Bit Design

FIG. 2 is view from the bottom of a roller cone bit which has three cones 201, 202, and 203, each containing rows of chisel-shaped inserts 210 for cutting elements. It can be noted that the "cones" in a roller cone bit need not be perfectly conical (nor perfectly frustroconical), but often have a slightly swollen axial profile. Moreover, the axes of the cones do not have to intersect the centerline of the borehole, as can be seen in this drawing. (The angular difference is referred to as the "offset" angle.) Another variable is the angle by which the centerline of the bearings intersects the horizontal plane of the bottom of the hole, and this angle is known as the journal angle. Thus as the drill bit is rotated, the cones typically do not roll true, and a certain amount of gouging and scraping takes place. The gouging and scraping action is complex in nature, and varies in magnitude and direction depending on a number of variables.

It should also be noted that while each cone has a row of teeth circumscribing its greatest circumference (this is the heel, or gage, row), the other rows of teeth are offset so that no two cones have teeth which will intersect each other as they rotate.

Conventional roller cone bits can be divided into two broad categories: Insert bits and steel-tooth bits. Steel tooth bits are utilized most frequently in softer formation drilling, whereas insert bits are utilized most frequently in medium and hard formation drilling.

Steel-tooth bits have steel teeth formed integral to the cone. (A hard-facing is typically applied to the surface of the teeth to improve the wear resistance of the structure.) Insert bits have very hard inserts (e.g. specially selected grades of tungsten carbide) press-fitted into holes drilled into the cone surfaces. The inserts extend outwardly beyond the surface of the cones to form the "teeth" that comprise the cutting structures of the drill bit.

The design of the component elements in a rock bit are interrelated (together with the size limitations imposed by the overall diameter of the bit), and some of the design parameters are driven by the intended use of the product. For example, cone angle and offset can be modified to increase or decrease the amount of bottom hole scraping. Many other design parameters are limited in that an increase in one parameter may necessarily result in a decrease of another. For example, increases in tooth length may cause interference with the adjacent cones.

Background: Tooth Design

The teeth of steel tooth bits are predominantly of the inverted "V" shape. The included angle (i.e. the sharpness of the tip) and the length of the tooth will vary with the design of the bit. In bits designed for harder formations the teeth will be shorter and the included angle will be greater. Gage row teeth (i.e. the teeth in the outermost row of the cone, next to the outer diameter of the borehole) may have a "T" shaped crest for additional wear resistance.

The most common shapes of inserts are spherical, conical, and chisel. Spherical inserts have a very small protrusion and are used for drilling the hardest formations. Conical inserts have a greater protrusion and a natural resistance to breakage, and are often used for drilling medium hard formations.

Chisel shaped inserts have opposing flats and a broad elongated crest, resembling the teeth of a steel tooth bit. Chisel shaped inserts are used for drilling soft to medium formations. The elongated crest of the chisel insert is normally oriented in alignment with the axis of cone rotation, as can be seen in FIG. 2. Thus, unlike spherical and conical inserts, the chisel insert may be directionally oriented about its center axis. (This is true of any tooth which is not axially symmetric.) The angle of orientation is measured as a deviation from the plane intersecting the center of the cone and the center of the tooth.

Background: Roller Cone Tracking

The study of bottom hole patterns has allowed engineers to evaluate performance and to begin to reduce such phenomena as tracking. FIG. 6A shows a computer generated pattern of the impressions of the teeth of a single roller cone on the hole bottom after a single revolution of the bit, showing a large separation between the individual teeth impressions, and between the rows on the cone.

FIG. 6C shows the impression of all of the cones on the bit after a single revolution of the bit. Note that while the inner rows of teeth from different cones do not generally follow the same path as they traverse the hole bottom, the teeth in the heel row of all of the cones tend to follow a single path on the outer circumference of the hole.

Tracking occurs when the teeth of a drill bit fall into the impressions in the formation formed by other teeth at a preceding moment in time during the revolution of the drill bit. FIG. 6B shows an impression of a single cone on the hole bottom after two revolutions of the bit. In this case, many of the impressions from the first revolution are partially overlain by the impressions of that same row from the second revolution. This overlapping will put lateral pressure on the teeth, tending to cause the cone to align with the previous impressions. Tracking can also happen when teeth of one cone's heel row fall into the impressions made by the teeth of another cone's heel row. Tracking results in slow rates of penetration, detrimental wear of the cutting structures and premature failure of bits.

Background: Bit Design to Prevent Tracking

The economics of drilling a well are strongly reliant on rate of penetration, which is itself strongly affected by the design of the cutting structures. Currently, roller cone bit designs remain the result of generations of modifications made to original designs. The modifications are based on years of experience in evaluating bit records, dull bit conditions, and bottom hole patterns, but these bit designs have not solved the issue of tracking.

One method commonly used to discourage bit tracking is known as a staggered tooth design. In this design the teeth are located at unequal intervals along the circumference of the cone. This is intended to interrupt the recurrent pattern of impressions on the bottom of the hole. However, staggered tooth designs do not prevent tracking of the outermost rows of teeth, where the teeth are encountering impressions in the formation left by teeth on other cones. Staggered tooth designs also have the short-coming that they can cause fluctuations in cone rotational speed and increased bit vibration.

U.S. Pat. No. 5,197,555 to Estes discloses milled-tooth cones with "the gage [row] of one cone oblique to the leading side and the gage row of another cone oblique to the trailing side".

Roller Cone Bits, Methods, and Systems with Anti-Tracking Variation in Tooth Orientation The present application discloses new bit and cone designs, as well as methods of design and systems and drilling methods using these designs, in which variation in tooth orientation is used to reduce tracking. (Of course, tooth orientation is only relevant if the teeth are not axisymmetric, e.g. with chisel shaped insert teeth.) At least two classes of embodiments are disclosed, which can be used separately or (to achieve a synergistic result) together.

The parent application described bit design procedures using control of tooth orientation as one of the design variables. In implementing those procedures, the present inventor realized that the variation in tooth orientation which is described in that application can also achieve a substantial improvement in tracking resistance. When one tooth's intrusion into the formation partly overlaps the impression made by a preceding tooth, a lateral force will result which tends to align the intrusion with the impression. However, the present inventor has realized that, when a tooth's orientation does NOT allow it to fully fit into the impression made by a previous tooth, the lateral force tending to pull the tooth toward the impression will be reduced (though typically not eliminated). By varying tooth orientation to avoid perfect fit between an impression and a following tooth (in some cases), the propensity to track can be reduced. The less perfect the match between one tooth and another, the more the propensity to track is reduced; for example, with chisel-shaped teeth, the maximum reduction in lateral force is achieved if a tooth is 90 degrees out of alignment with a following tooth; but significant reductions can be achieved even with 30 degrees of misalignment.

Co-pending application Ser. No. 09/387,304, filed Aug. 31, 1999, now U.S. Pat. No. 6,095,262 and which is hereby incorporated by reference, discloses a method of optimizing the tooth orientation on a cone. It is herein disclosed that within an optimal range of orientations, the tooth orientation within a single row or between the heel rows of two or more cones can be varied to lessen the propensity for tracking. It is understood in this context that references to "tooth" or "teeth" include both milled teeth and elongated inserts, and that the invention is not specifically limited to the use of steel teeth.

In one class of embodiments, the orientations of the teeth are varied between the heel row of one cone and the heel row of another cone. Since the heel rows of all three cones normally follow the same path, reduction in tracking propensity is particularly useful here.

In another class of embodiments, the orientations of the teeth are varied within a single row of a cone. This helps to avoid same-row tracking forces: tracking is not only caused by the impressions of a preceding cone. The inner rows of teeth are usually spaced so that no two rows follow the same path on the cutting face; but a single row of teeth, on a single cone, will still encounter the impressions left by its own previous path. Since a full circle of a row's path will not necessarily be an exact multiple of the spacing of impressions on the cutting face, the misalignment of teeth to previous impressions may indeed contribute a lateral force component. Here too a difference in orientation between tooth and impression helps to reduce this lateral force component. The different tooth orientations can be grouped in blocks in a given row, such as a block of teeth with orientation A which extends over half the row circumference and a block of teeth with orientation B which extends over the other half; or blocks ABAB, where each block extends over 90 degrees; or blocks ABC; or the blocks can have unequal numbers of teeth.

The disclosed innovations, in various embodiments, provide one or more of at least the following advantages:

- reduces propensity to track rows on different cones that drill the same circumferential path of the hole bottom;
- reduces propensity to track the other teeth on the same row of a cone;
- minimizes vibration during drilling;
- increases lifetime of drill bit and drill string components;
- reduces drilling cost-per-foot.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Co-pending application Ser. No. 09/387,304, filed Aug. 31, 1999, now U.S. Pat. No. 6,095,262 discloses a method of determining the trajectory of each tooth as it traverses the hole bottom, then using this information to optimize the orientation of the teeth accordingly. In all examples discussing the orientation of the teeth, it is understood that all angles will be chosen to be within an optimal range, as determined by this or a similar method, so that drilling efficiency is not adversely affected.

Figure 1A:
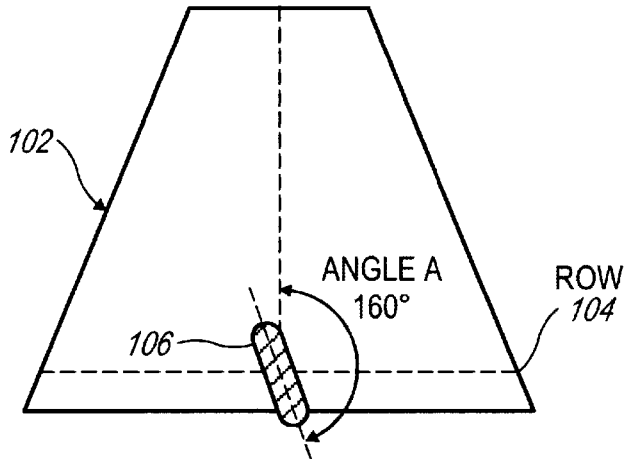
FIGS. 1A to 1C are schematic side views of first, second, and third cones of a drill bit showing only their heel rows, which are oriented in accordance with a preferred embodiment of the present invention.

FIG. 1A is schematic side view of first cone 102 of a three-cone bit in accordance with a preferred embodiment of the present disclosure. This diagram shows only one tooth in the outermost or gage row, however it will be understood that the cone has multiple rows of teeth, with multiple teeth in the rows. The tooth shown in cone 102 in the outermost row 104 has chisel shaped inserts 106 in which the elongated portion of chisel inserts 106 are orientated at an angle A, here 160 degrees from the center axis of rotation of cone 102

Figure 1B:
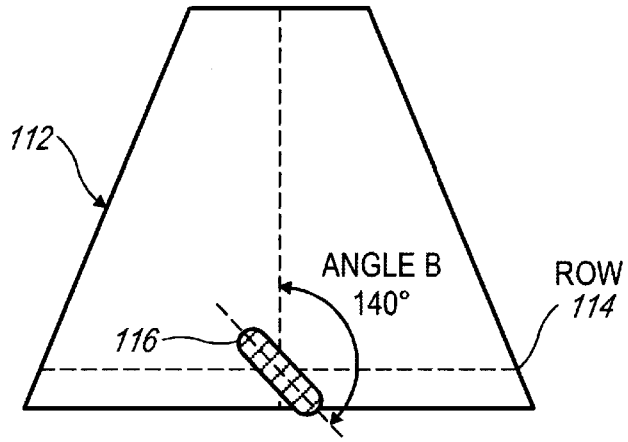

FIG. 1B is schematic side view of a second cone 112 of the same roller cone bit. Cone 112 has an outermost row 114 having chisel shaped inserts 116 in which the elongated portion of the chisel inserts are oriented at an angle B, here 140 degrees from the center axis of rotation of cone 112. Principle to this embodiment is that angle A and angle B are not the same, but both are within the optimal range of angles as determined by the method of application Ser. No. 09/387,304, filed Aug. 31, 1999, U.S. Pat. No. 6,095,262. In this configuration, teeth 106 of first cone 102, and teeth 116 of second cone 112 are thus aligned in different orientations. The difference in orientation causes the generation of dissimilar impressions in the hole bottom pattern by teeth 106 and teeth 116. Tracking by the consecutive engagement of teeth 106, and teeth 116 with the formation is thus prevented.

Figure 1C:
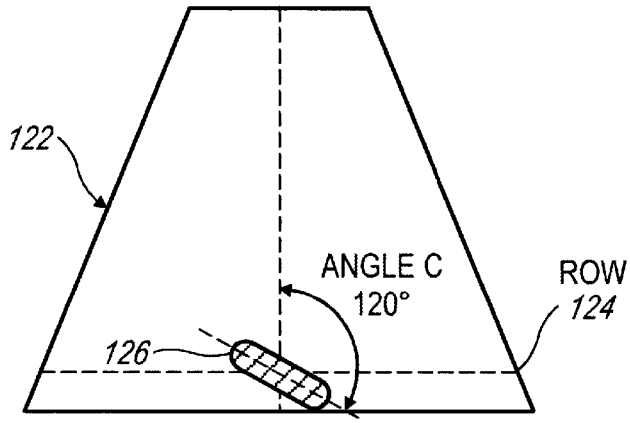

FIG. 1C is a schematic side view of a cone 122 of the same roller cone bit. Cone 122 has an outermost row 124 having chisel shaped inserts 126 in which the elongated portion of chisel inserts 126 are orientated at an angle C, here 160 degrees from the center axis of rotation of cone 122. Note that angle C is different from both angle A and angle B, but will still be within the optimal range determined for this location.

Figure 1D:
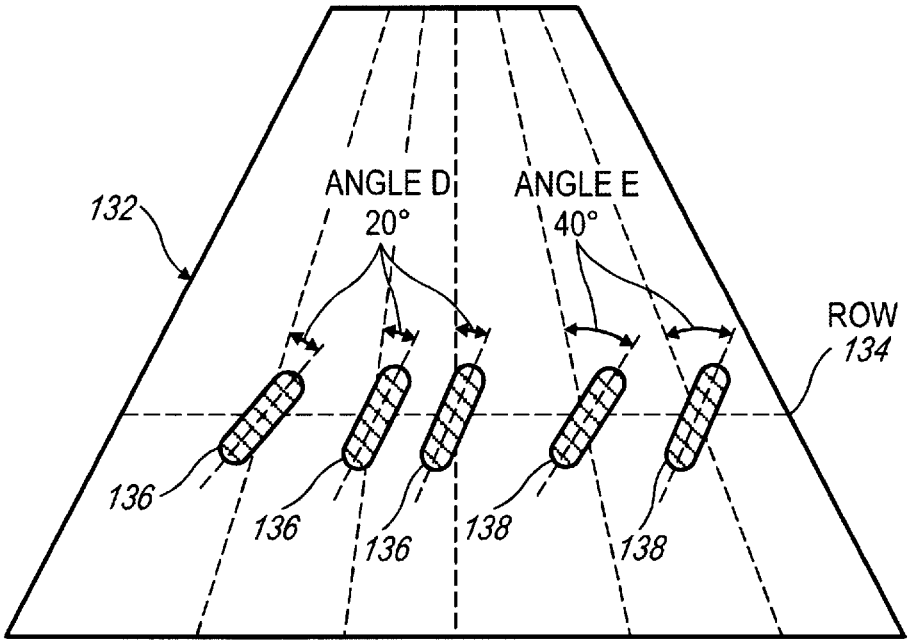
FIG. 1D is a schematic side view of a drill bit cone showing only an inner row of teeth oriented in accordance with a preferred embodiment of the present invention.
Figure 2:
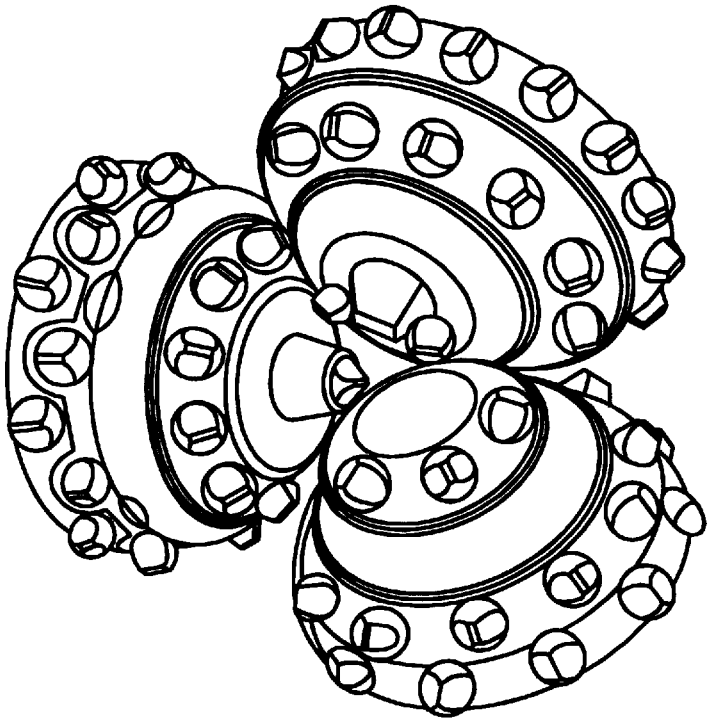
FIG. 2 is a view from the bottom of a conventional drill bit having three cones with chisel inserts for teeth.
Figure 3:
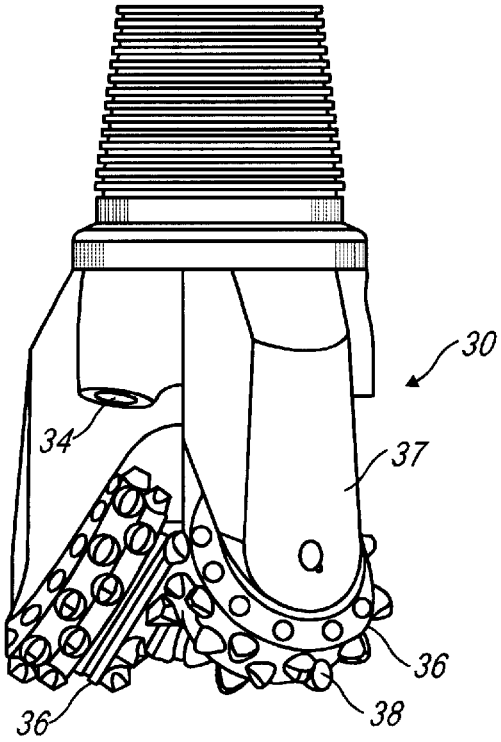
FIG. 3 (PRIOR ART)
FIG. 3 is a side view of a conventional roller cone bit.
Figure 4:
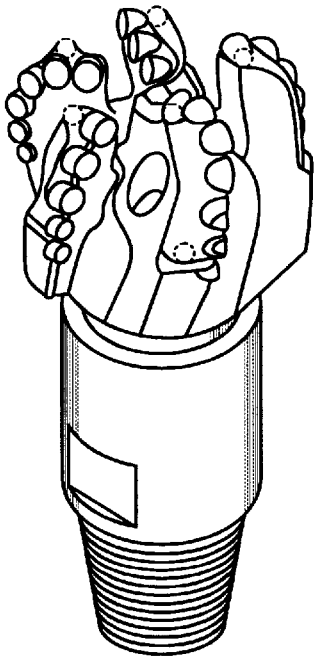
FIG. 4 (PRIOR ART)
FIG. 4 is a side view of a conventional drag bit.
Figure 5:
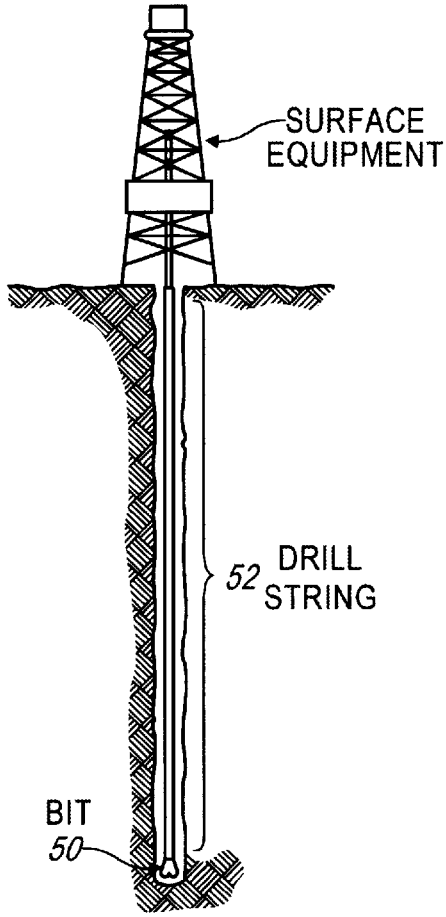
FIG. 5 (PRIOR ART)
FIG. 5 is a side view schematic of a drilling rig.
Figure 6A:
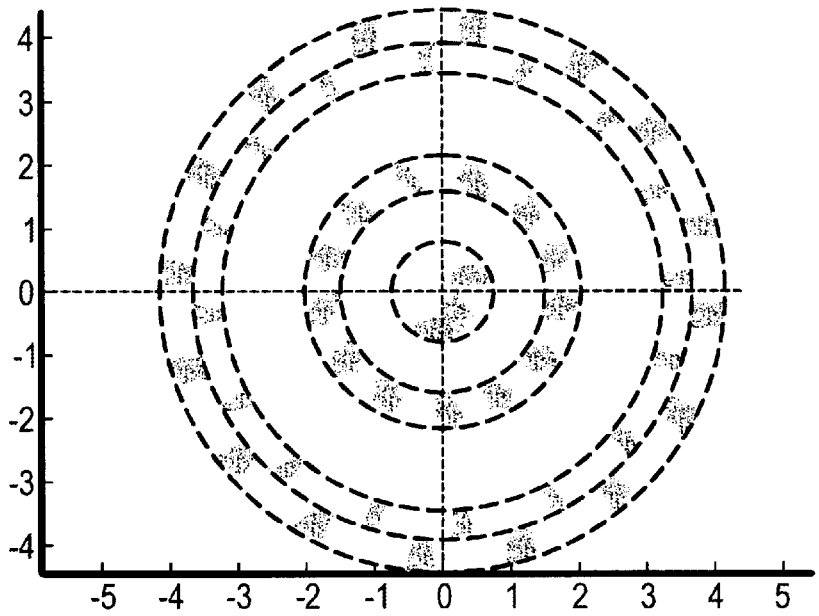
FIGS. 6A–C are examples respectively of the impression distribution on the hole bottom of A) a first cone on a drill bit after one bit revolution, B) a first cone on a drill bit after two bit revolutions, showing how tracking can occur, and C) all teeth of a bit after one bit revolution.
Figure 6B:
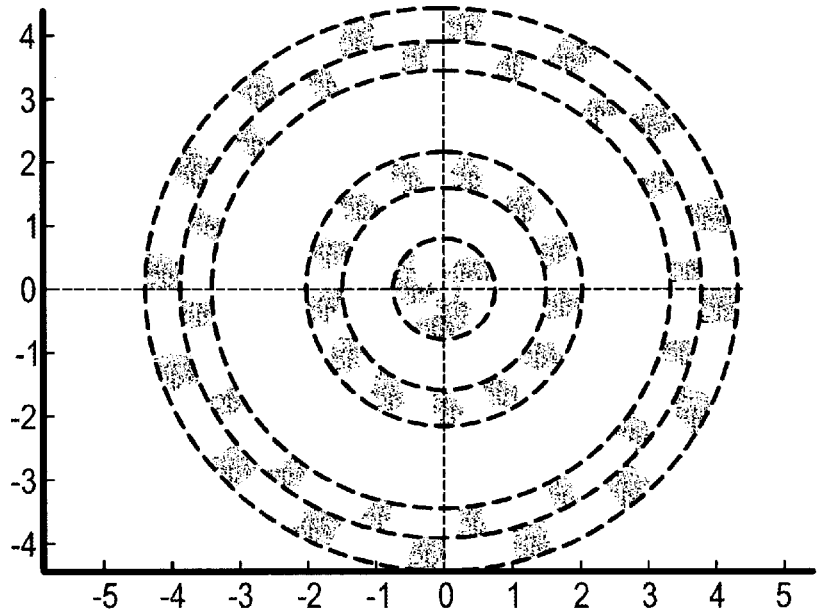
Figure 6C:
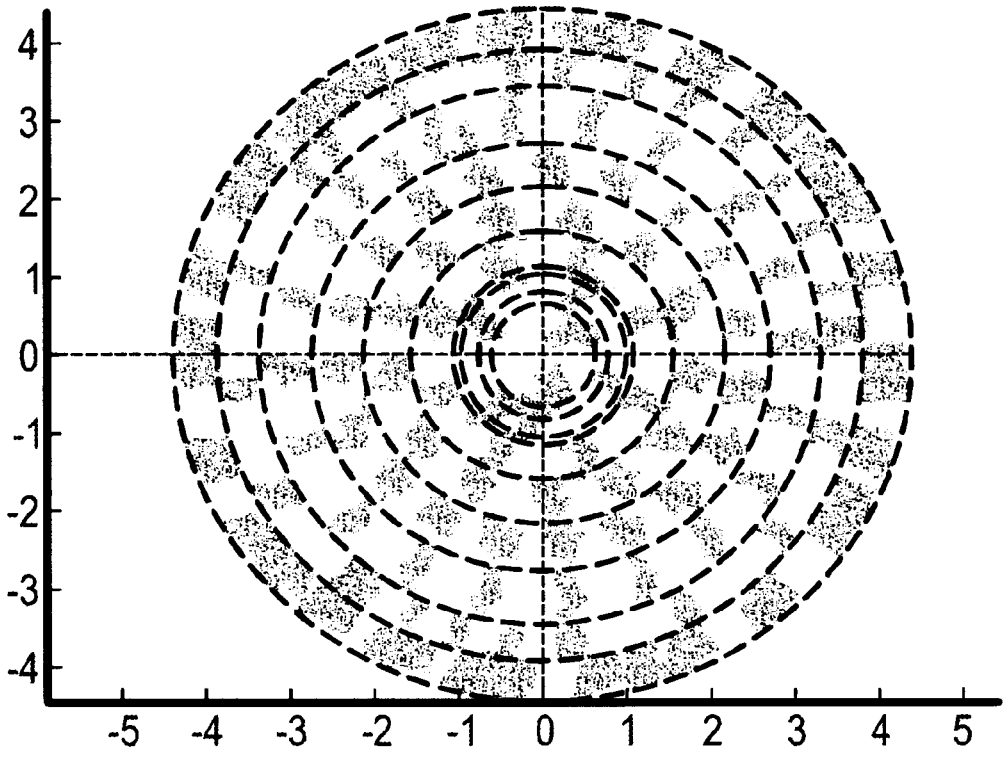

FIG. 1D is a schematic side view of a cone 132 of a roller cone bit. Cone 132 has an inner row 134 having chisel shaped inserts 136 in which the elongated portion of chisel inserts 136 are orientated at an angle D, here 20 degrees from the center axis of rotation of cone 132. Also in inner row 134, are chisel inserts 138, in which the elongated portion of the chisel inserts is orientated at an angle E, here 40 degrees from the center axis of rotation of cone 132. Principle to this embodiment is that angle D and angle E are not the same, but are within an optimal range. In this configuration, teeth 136 of row 134, and teeth 138 of row 134 are thus aligned in different orientations. The difference in orientation causes the generation of dissimilar impressions on the hole bottom by teeth 136 and teeth 138. Tracking by the consecutive engagement of teeth 136, and teeth 138 with the formation is thus prevented.

Operation of the Invention

In the operation of the preferred embodiment, a roller cone rock bit has a first cone 102 having an outermost row 104 of teeth 106 oriented at an angle A degrees to the center axis of cone 102. The roller cone rock bit has a second cone 112 having an outermost row 114 of teeth 116 oriented at an angle B degrees to the center axis of cone 112. Since angle A does not equal angle B, teeth 106 of first cone 102, and teeth 116 of second cone 112 are thus aligned at different orientations. When operating torque and weight are applied to the rock bit, teeth 106 and teeth 116 will engage the formation of the hole bottom and crush and scrap the formation away. In doing so, each engagement of teeth 106 and teeth 116 results in the creation of a crater in the hole bottom. The shape and size of the craters depends in a large part on the precise orientations of teeth 106 and teeth 116 in relation to the center axes of respective first cone 102 and second cone 112. The difference in orientation causes the generation of dissimilar impressions on the hole bottom by teeth 106 and teeth 116. Since outermost rows 104 and 114 of cones 102 and 112 follow each other in substantially the same path around the well bottom as the rock bit rotates, tracking by the consecutive engagement of teeth 106 and 116 with the formation is prevented.

In accordance with another preferred embodiment of the present invention, a roller cone rock bit has a cone 122. Cone 122 has an inner row 124, in which is located tooth 126. Tooth 126 is oriented at an angle A degrees to the center axis of cone 122. Also located in inner row 124 is tooth 128. Tooth 128 is oriented at an angle B degrees to the center axis of cone 122. Since angle A and angle B are not equal in this configuration, tooth 126 and tooth 128 are aligned at different orientations. The difference in orientation causes the generation of dissimilar impressions on the hole bottom by tooth 126 and tooth 128. Since inner row 124 of cone 122 drills a concentric ring in the hole bottom without substantial overlap by the teeth of other cones, tracking by the consecutive engagement of tooth 126, and tooth 128 with the formation is prevented.

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

The "cones" in a roller cone bit need not be perfectly conical (nor perfectly frustroconical), but often have a slightly swollen axial profile.

Offset angle: the angular difference by which the axes of the cones do not intersect the centerline of the borehole.

Journal angle: the angle by which the centerline of the bearings intersects the horizontal plane of the bottom of the hole.

Gage row or heel row: the outermost row of teeth on a roller cone, i.e. the teeth which come nearest to the outermost diameter of the hole bottom.

According to a disclosed class of innovative embodiments, there is provided: A roller cone bit comprising: a plurality of non-axially-symmetric teeth mounted on rotatable elements, wherein ones of said teeth which follow the same path on a cutting face have different axial orientations; whereby the likelihood of tracking is reduced.

According to another disclosed class of innovative embodiments, there is provided: A bit for downhole rotary drilling, comprising: a rotatable element which includes a row of teeth; wherein a first one of said teeth has a first orientation and a second one of said teeth has a second orientation which differs from said first orientation.

According to another disclosed class of innovative embodiments, there is provided: A bit for downhole rotary drilling, comprising: a body having an attachment portion capable of being attached to a drill string; cutting elements rotatably attached to said body, each said element including multiple rows of teeth; wherein at least one of said rows on at least one said cutting element includes first and second teeth which are non-axisymmetric; wherein said first tooth has a first orientation and said second tooth has a second orientation which differs from said first orientation.

According to another disclosed class of innovative embodiments, there is provided: A drill bit, comprising: a plurality of rotatable elements mounted to roll along a cutting face when said drill bit is rotated under load, each said rotatable element having a heel row and inner rows of teeth thereon; wherein ones of said teeth in the heel row of a first one of said plurality of rotatable elements have crest orientations which are different from ones of said teeth in the heel row of a second one of said plurality of rotatable elements.

According to another disclosed class of innovative embodiments, there is provided: A roller cone bit comprising: a plurality of cones, each cone having a circumferential outermost row containing a plurality of teeth; a first cone, having in its outermost row a first plurality of teeth having a first axial orientation; and, a second cone, having in its outermost row, a second plurality of teeth having a second axial orientation which is not the same as said first axial orientation.

According to another disclosed class of innovative embodiments, there is provided: A rotary drilling system, comprising: a drill string which is connected to a bit; and a rotary drive which rotates at least part of said drill string together with said bit; wherein said bit comprises a plurality of rotatable elements mounted to roll along a cutting face when said drill bit is rotated under load, each said rotatable element having teeth thereon; wherein ones of said teeth which follow the same path on a cutting face have different axial orientations.

According to another disclosed class of innovative embodiments, there is provided: A rotary drilling system, comprising: a drill string which is connected to a bit; and a rotary drive which rotates at least part of said drill string together with said bit; wherein said bit comprises a plurality of rotatable elements mounted to roll along a cutting face when said drill bit is rotated under load, each said rotatable element having an outer row and inner rows of teeth thereon; wherein a first plurality of said teeth have crest orientations which are different from the crest orientations of a second plurality of teeth in said bit.

According to another disclosed class of innovative embodiments, there is provided: A method of designing a bit for rotary drilling, comprising the actions of: determining an optimal range of orientations for teeth for each row of each cone; providing a variation in the orientations of ones of said teeth which follow the same path on a cutting face; whereby tracking is reduced.

According to another disclosed class of innovative embodiments, there is provided: A method for rotary drilling, comprising the actions of: (a.) installing, on the drill string, a rotary drill bit whose tooth orientation has been optimized to provide a variation in the orientations of ones of said teeth which follow the same path on a cutting face; (b.) rotating at least a portion of said drill string which includes said drill bit; whereby tracking is reduced.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

Additional general background, which helps to show the knowledge of those skilled in the art regarding implementations and the predictability of variations, may be found in the following publications, all of which are hereby incorporated by reference: APPLIED DRILLING ENGINEERING, Adam T. Bourgoyne Jr. et al., Society of Petroleum Engineers Textbook series (1991), OIL AND GAS FIELD DEVELOPMENT TECHNIQUES: DRILLING, J.-P. Nguyen (translation 1996, from French original 1993), MAKING HOLE (1983) and DRILLING MUD (1984), both part of the Rotary Drilling Series, edited by Charles Kirkley.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A roller cone bit comprising:

a plurality of non-axially-symmetric teeth mounted on rotatable elements, wherein ones of said teeth which follow the same path on a cutting face have different axial orientations;

wherein a first plurality of said ones of said teeth are contiguous and all have a first orientation, and a second plurality of said ones of teeth are contiguous and all have a second orientation;

whereby the likelihood of tracking is reduced.

2. A bit for downhole rotary drilling, comprising:

a rotatable element which includes a row of teeth;

wherein a first plurality of said teeth are contiguous and all have a first orientation, and a second plurality of said teeth are contiguous and all have a second orientation which differs from said first orientation.

3. A bit for downhole rotary drilling, comprising:

a body having an attachment portion capable of being attached to a drill string;

cutting elements rotatably attached to said body, each said element including multiple rows of teeth;

wherein at least one of said rows on at least one said cutting element includes teeth which are non-axisymmetric;

wherein a first plurality of said non-axisymmetric teeth are contiguous and all have a first orientation, and a second plurality of said non-axisymmetric teeth are contiguous and all have a second orientation which differs from said first orientation.

4. The bit of claim 3, wherein said bit is a tricone bit.

5. A drill bit, comprising:

a plurality of rotatable elements mounted to roll along a cutting face when said drill bit is rotated under load, each said rotatable element having a heel row and inner rows of teeth thereon;

wherein multiple contiguous ones of said teeth in the heel row of a first one of said plurality of rotatable elements have a common crest orientation which is different from ones of said teeth in the heel row of a second one of said plurality of rotatable elements.

6. A roller cone bit comprising:

a plurality of cones, each cone having a circumferential outermost row containing a plurality of teeth;

a first cone, having in its outermost row a first contiguous plurality of teeth having a first axial orientation; and a second cone, having in its outermost row a second contiguous plurality of teeth having a second axial orientation which is not the same as said first axial orientation.

7. The roller cone bit of claim 6, further comprising a third cone, having in its outermost row, a third plurality of teeth having a third axial orientation which is not the same as said first or said second axial orientation.

8. A rotary drilling system, comprising:

a drill string which is connected to a bit; and a rotary drive which rotates at least part of said drill string together with said bit;

wherein said bit comprises a plurality of rotatable elements mounted to roll along a cutting face when said drill bit is rotated under load, each said rotatable element having teeth thereon;

wherein ones of said teeth which follow the same path on a cutting face have different axial orientations;

wherein a first plurality of said ones of said teeth are contiguous and have a first orientation, and a second plurality of said ones of said teeth are contiguous and have a second orientation which is different from said first orientation.

9. A method of designing a bit for rotary drilling, comprising the actions of:

determining an optimal range of orientations for teeth for each row of each cone;

providing a variation in the orientations of ones of said teeth which follow the same path on a cutting face;

wherein a first contiguous plurality of said ones of said teeth have a first orientation at a first end of said optimal range of orientations, and a second contiguous plurality of said ones of said teeth have a second orientation at an opposite end of said optimal range;

whereby tracking is reduced.

10. A method for rotary drilling, comprising the actions of:

(a) installing, on the drill string, a rotary drill bit whose tooth orientation has been optimized to provide a difference in the orientations of a first contiguous plurality and a second contiguous plurality of said teeth which follow the same path on a cutting face;

(b) rotating at least a portion of said drill string which includes said drill bit;

whereby tracking is reduced.

11. The method of claim 10, further comprising pumping mud down said drill string to exit said rotary drill bit.

* * * * *